US007142113B2

(12) United States Patent
Lian et al.

(10) Patent No.: US 7,142,113 B2
(45) Date of Patent: Nov. 28, 2006

(54) METHOD AND APPARATUS TO DETECT AN EXTERNAL SOURCE

(75) Inventors: Ming-Ren Lian, Boca Raton, FL (US); Gary Mark Shafer, Boca Raton, FL (US); Hubert A. Patterson, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 76 days.

(21) Appl. No.: 10/780,024

(22) Filed: Feb. 17, 2004

(65) Prior Publication Data

US 2005/0179543 A1 Aug. 18, 2005

(51) Int. Cl.
*G08B 13/08* (2006.01)

(52) U.S. Cl. ..... 340/547; 340/540; 340/545.1; 340/551; 340/572.6

(58) Field of Classification Search ..... None
See application file for complete search history.

(56) References Cited

U.S. PATENT DOCUMENTS 4,001,718 A * 1/1977 Wilson et al. ..... 331/65
4,063,230 A * 12/1977 Purinton et al. ..... 340/572.4
4,068,189 A * 1/1978 Wilson ..... 331/65
4,510,489 A 4/1985 Anderson, III et al.
4,595,915 A * 6/1986 Close ..... 340/572.2
4,618,823 A * 10/1986 Dahlheimer et al. ... 324/207.16
5,227,667 A * 7/1993 Takinami et al. ..... 307/129
5,339,051 A 8/1994 Koehler et al.
5,508,662 A * 4/1996 Guichard et al. ..... 331/65
5,514,337 A * 5/1996 Groger et al. ..... 422/82.08
5,519,317 A * 5/1996 Guichard et al. ..... 324/236
5,942,991 A * 8/1999 Gaudreau et al. ..... 340/870.16
5,986,549 A * 11/1999 Teodorescu ..... 340/561
6,834,251 B1 * 12/2004 Fletcher ..... 702/150
6,847,215 B1 * 1/2005 Goezinne ..... 324/655
2003/0048186 A1 * 3/2003 Machul ..... 340/572.5

FOREIGN PATENT DOCUMENTS

WO WO 03/050490 6/2003

OTHER PUBLICATIONS

Qing Y. Cai, et al., "A wireless, remote query magnetoelastic CO2 sensor," The Royal Society of Chemistry 2000, J. Environ. Monit., 2000, pp. 556-560.

* cited by examiner

*Primary Examiner*—Benjamin C. Lee
*Assistant Examiner*—Son Tang

(57) ABSTRACT

A method and apparatus to detect an external source are described.

23 Claims, 9 Drawing Sheets

METHOD AND APPARATUS TO DETECT AN EXTERNAL SOURCE

BACKGROUND

A monitoring system may be designed to monitor and detect changes in a monitored area or item. For example, a monitoring system may be used as part of a security system. The security system may use a detection device to determine changes in a monitored area, such as a house or office. For example, the detection device may be configured to determine whether a door is open or closed. In another example, the detection device may be configured to determine whether a door is locked or unlocked. In yet another example, the detection device may be configured to determine the presence of an analyte, such as a chemical or gas. Consequently, improvements in such detection devices may lead to improved performance of the monitoring system, thereby resulting in improved safety of the occupants of the monitored area. Accordingly, there may be a significant need for improvements in such techniques in a device or system.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

The embodiments may be directed to a method and apparatus to use a marker to detect changes in ambient conditions surrounding the marker. The marker may comprise, for example, a marker used in an Electronic Article Surveillance (EAS) security tag. The marker may resonate at a certain frequency referred to as a "resonate frequency." The resonant frequency may vary depending on a number of factors, such as magnetic field strength, loaded weight, stress, temperature, and so forth. Once the resonant frequency of the marker has been established, variations in the resonant frequency may be correlated to a change in one or more ambient conditions in the environment of the marker.

In one embodiment, for example, an oscillation circuit may be configured to generate an oscillation signal using a marker. The oscillation circuit may modify a characteristic of the oscillation signal in response to an external source. The external source may comprise an object or physical characteristic of the environment. One or more sensors may be configured to receive the oscillation signal and detect any modifications to the oscillation signal. The sensor(s) may generate a detect output signal in accordance with the detected modification.

Numerous specific details may be set forth herein to provide a thorough understanding of the embodiments of the invention. It will be understood by those skilled in the art, however, that the embodiments of the invention may be practiced without these specific details. In other instances, well-known methods, procedures, components and circuits have not been described in detail so as not to obscure the embodiments of the invention. It can be appreciated that the specific structural and functional details disclosed herein may be representative and do not necessarily limit the scope of the invention.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
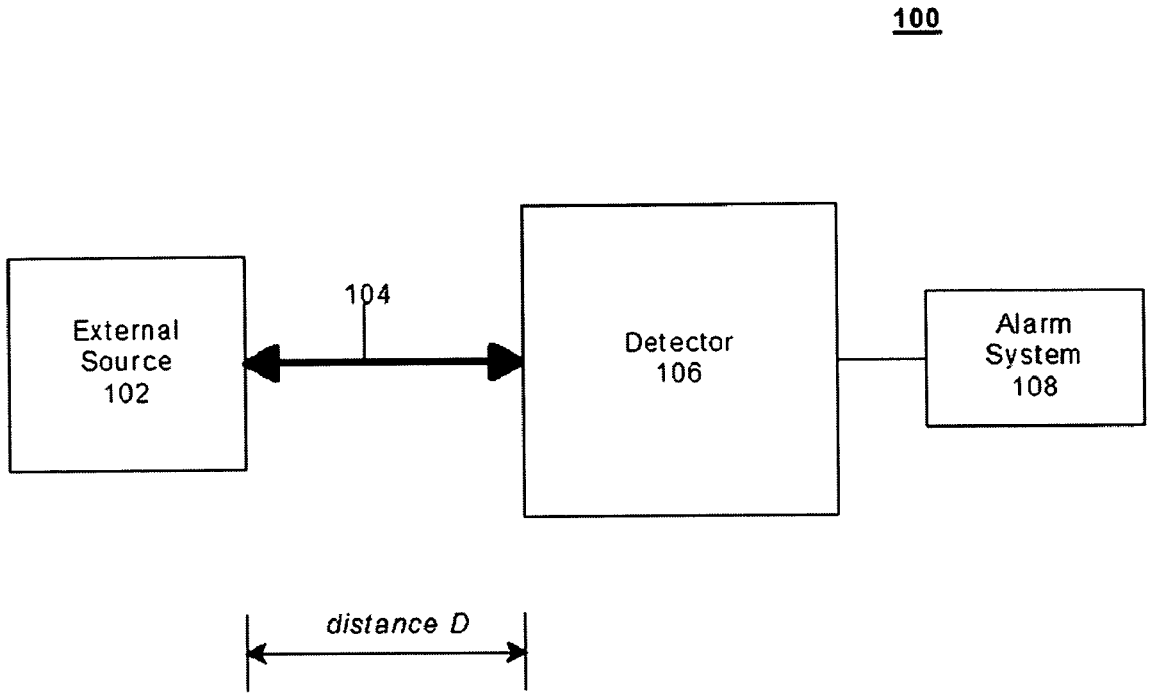
FIG. 1 illustrates a monitoring system suitable for practicing one embodiment.

Referring now in detail to the drawings wherein like parts are designated by like reference numerals throughout, there is illustrated in FIG. 1 a monitoring system suitable for practicing one embodiment. FIG. 1 is a block diagram of a monitoring system 100. Monitoring system 100 may comprise a plurality of nodes. The term "node" as used herein may refer to a system, element, module, component, board or device that may process a signal representing information. The signal may be, for example, an electrical signal, optical signal, acoustical signal, chemical signal, and so forth. The embodiments are not limited in this context.

As shown in FIG. 1, monitoring system 100 may comprise an external source 102, a detector 106, and an alarm system 108. Although FIG. 1 shows a limited number of nodes, it can be appreciated that any number of nodes may be used in monitoring system 100. The embodiments are not limited in this context.

In one embodiment, monitoring system 100 may comprise external source 102. External source 102 may comprise an object or physical characteristic of the environment within a given proximity or range of detector 106. For example, external source 102 may comprise an object, such as a quantity of metal, a magnet, and so forth. In another example, external source 102 may comprise a physical characteristic or ambient condition of the environment, such as temperature, chemical composition, magnetic field strength, stress, pressure, and so forth. The embodiments are not limited in this context.

In one embodiment, monitoring system 100 may comprise a detector 106. Detector 106 may be a detection device configured to detect external source 102. For example, detector 106 may comprise a metal detector to detect a certain type and amount of metal. In another example, detector 106 may be configured to detect changes in a Direct Current (DC) or Alternating Current (AC) magnetic field. In yet another example, detector 106 may be a chemical detector to detect the presence of a certain chemical or gas.

In another example, detector 106 may be a temperature detector. The embodiments are not limited in this context.

In one embodiment, monitoring system 100 may comprise an alarm system 108. Alarm system 108 may comprise any type of alarm system to provide an alarm in response to an alarm signal. The alarm signal may be received from detector 106, for example. Alarm system 108 may comprise a user interface to program conditions or rules for triggering an alarm. Examples of the alarm may comprise an audible alarm such as a siren or bell, a visual alarm such as flashing lights, or a silent alarm. A silent alarm may comprise, for example, an inaudible alarm such as a message to a monitoring system for a security company. The message may be sent via a computer network, a telephone network, a paging network, and so forth. The embodiments are not limited in this context.

In general operation, monitoring system 100 may be used to monitor and detect changes in one or more ambient conditions of the environment surrounding detector 106. For example, detector 106 may be configured to detect changes caused by external source 102. Detector 106 may detect such changes within a given range or proximity of detector 106. The range of detector 106 may increase or decrease for a given implementation as represented by line 104 having a distance D. Once detector 106 detects a change caused by external source 102, detector 106 may output a detect output signal to alarm system 108. Alarm system 108 may be configured to alert an operator or user of the change in external source 102.

Figure 2:
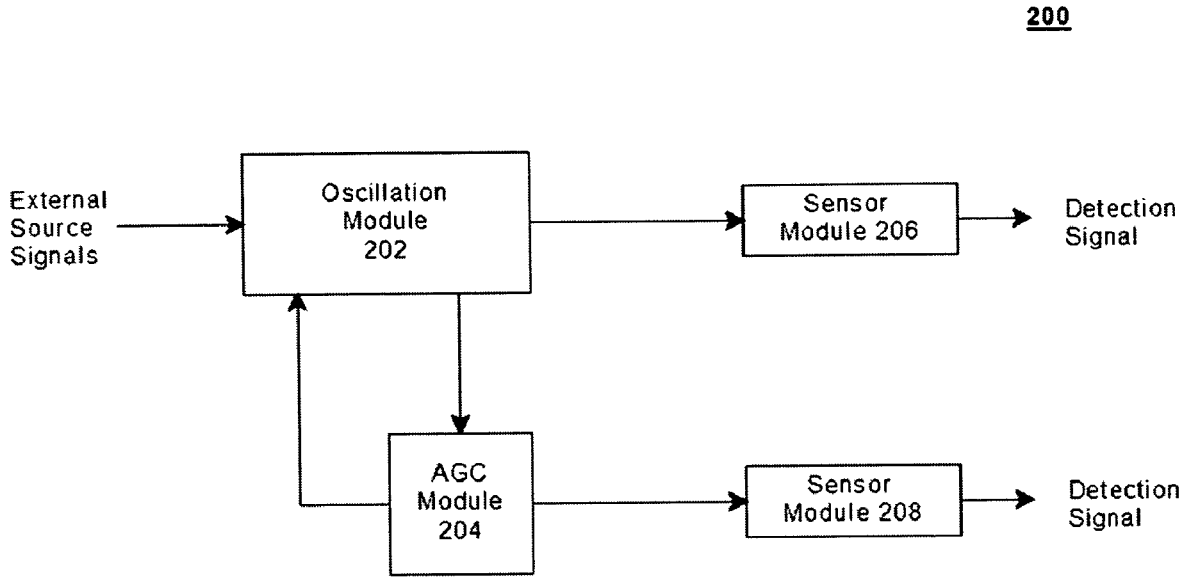
FIG. 2 illustrates a block diagram of a detector in accordance with one embodiment.

FIG. 2 may illustrate a system in accordance with one embodiment. FIG. 2 may illustrate a system 200. System 200 may be representative of, for example, detector 106. System 200 may comprise one or more modules. Although the embodiment has been described in terms of "modules" to facilitate description, one or more circuits, components, registers, processors, software subroutines, or any combination thereof could be substituted for one, several, or all of the modules. The embodiments are not limited in this context.

As shown in FIG. 2, system 200 may comprise an oscillation module 202, an automatic gain control (AGC) module 204, a sensor module 206 and a sensor module 208. Although FIG. 2 shows a limited number of modules, it can be appreciated that any number of modules may be used in system 200.

In one embodiment, system 200 may comprise oscillation module 202. Oscillation module 202 may be configured to output an oscillation signal tuned to the resonant frequency of a marker. Oscillation module 202 may modify a characteristic of the oscillation signal in response to external source 102. For example, the characteristic may be a frequency component of the oscillation signal. In another example, the characteristic may be an amplitude component of the oscillation signal. Consequently, changes in external source 102 may cause changes in the frequency or amplitude of the oscillation signal from oscillation module 202.

In one embodiment, system 200 may comprise one or more sensor modules, such as sensor module 206 and sensor module 208. The sensor modules may be configured to detect changes in one or more characteristics of the oscillation signal received from oscillation module 202. For example, sensor 206 may be configured to detect frequency changes in the oscillation signal. In another example, sensor 208 may be configured to detect amplitude changes in the oscillation signal. Once the sensor modules detect a change in the monitored characteristics, the sensor modules may output a detect output signal to indicate that a change has occurred.

In one embodiment, system 200 may comprise an AGC module 204. AGC module 204 may be configured to automatically control the amount of gain used for one or more signals of oscillation module 202. AGC 204 may receive an output signal from oscillation module 202, determine an amount of gain for the output signal, and output a gain control signal in accordance with the determination. Oscillation module 202 may receive the gain control signal, and modify the amount of gain for one or more signals used by oscillation module 202.

In general operation, system 200 may be configured to detect a change in external source 102. Oscillation module 202 may output an oscillation signal reflecting the resonant frequency of a marker. AGC module 204 may assist in adjusting the amount of gain needed to generate the appropriate oscillation signal. Changes in external source 102 may affect the resonant frequency of the marker, thereby causing a change in one or more characteristics of the oscillation signal from oscillation module 202. Sensor modules 206 and 208 may be configured to detect the change in characteristics, and output a detect output signal representing the respective changes. The detect output signals may be used to provide notice of the change via alarm system 108, for example. In this manner, a user may remotely monitor changes in a remote environment, such as a security system configured to monitor a home or office, for example.

Figure 3:
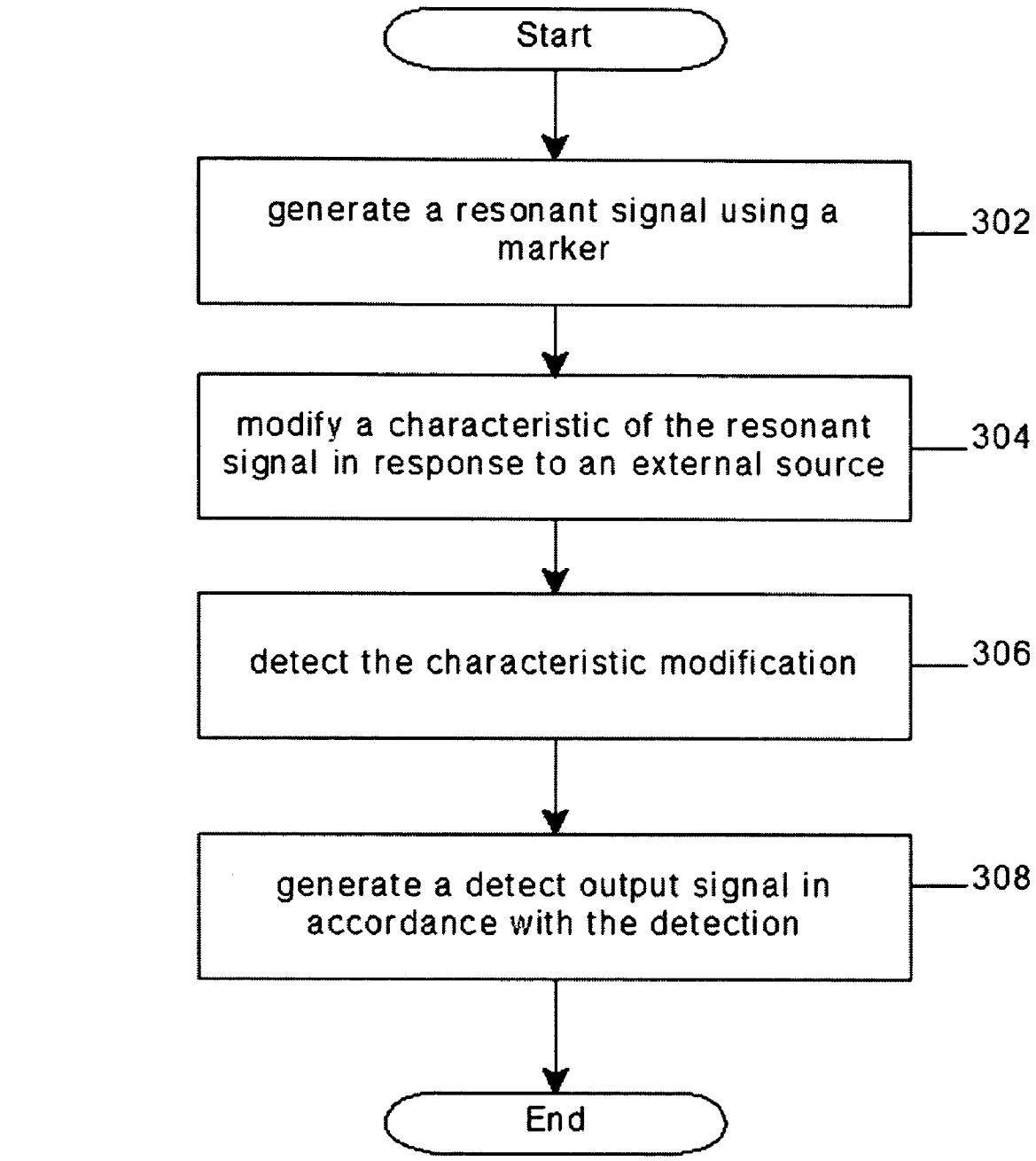
FIG. 3 is a block flow diagram of the programming logic performed by a detector in accordance with one embodiment.

FIG. 3 illustrates a programming logic for a detector in accordance with one embodiment. Although FIG. 3 as presented herein may include a particular programming logic, it can be appreciated that the programming logic merely provides an example of how the general functionality described herein can be implemented. Further, the given programming logic does not necessarily have to be executed in the order presented unless otherwise indicated. In addition, although the given programming logic may be described herein as being implemented in the above-referenced modules, it can be appreciated that the programming logic may be implemented anywhere within the system and still fall within the scope of the embodiments.

FIG. 3 illustrates a programming logic 300 that may be representative of the operations executed by a detector in accordance with one embodiment. As shown in programming logic 300, an oscillation signal may be generated using a marker at block 302. At least one characteristic of the oscillation signal may be modified in response to an external source at block 304. The modification of the characteristic may be detected at block 306. A detect output signal may be generated at block 308.

In one embodiment, the oscillation signal may be generated by an oscillation module, such as oscillation module 202. Oscillation module 202 may create an AC magnetic field. The AC magnetic field may stimulate a marker to generate a marker signal. The marker signal may be received and amplified to form an amplified signal. The AC magnetic field may be increased in response to the amplified signal. This loop to continuously amplify the marker signal may be performed until gain for the amplified signal reaches a predetermined threshold to form the appropriate oscillation signal. The appropriate oscillation signal may be an oscillation signal having a frequency substantially matching a frequency for the marker signal, for example.

Figure 4:
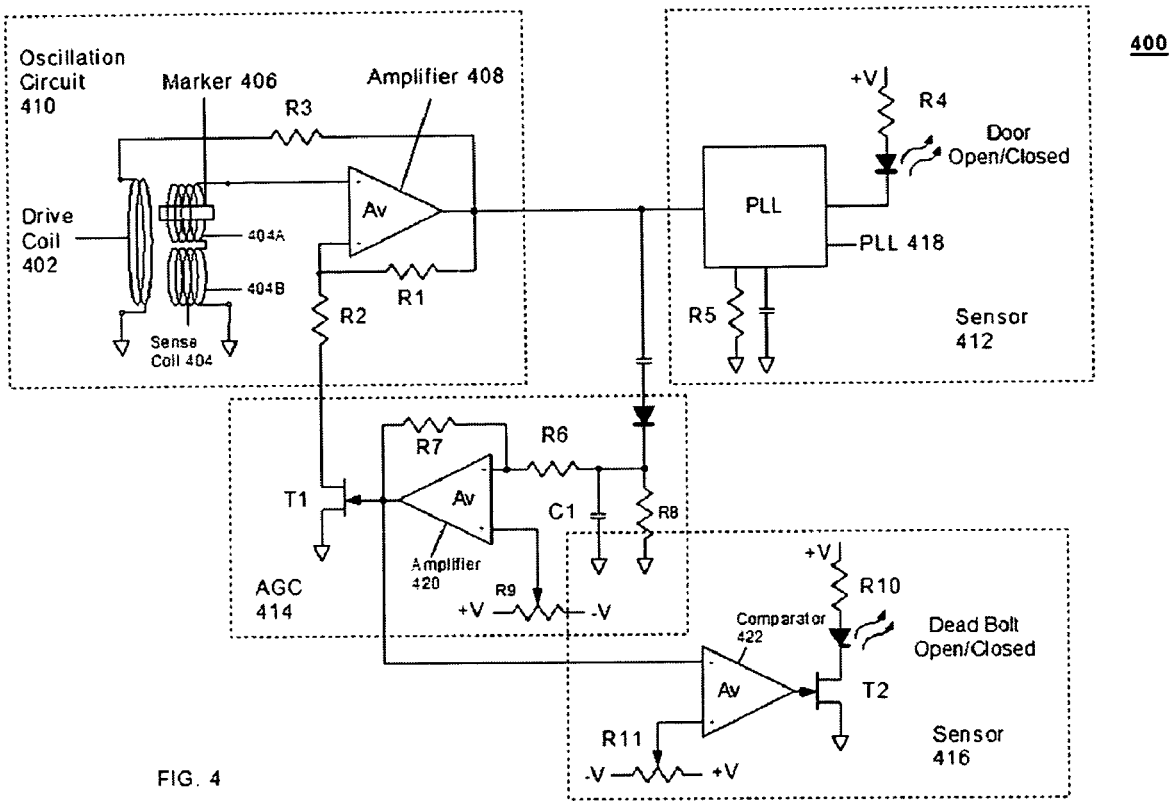
FIG. 4 is a circuit to implement a detector in accordance with one embodiment.

FIG. 4 is a circuit to implement a detector in accordance with one embodiment. FIG. 4 may illustrate a circuit 400. Circuit 400 may be representative of, for example, system 200. As shown in FIG. 4, circuit 400 may comprise an oscillation circuit 410, a sensor 412, an AGC circuit 414, and a sensor 416. In one embodiment, for example, AGC circuit 414 and sensors 412 and 416 may be implemented using a Digital Signal Processor (DSP) and accompanying architecture. The embodiments are not limited in this context.

In one embodiment, circuit 400 may also comprise sensor 412. Sensor 412 may comprise a phase-locked loop (PLL) circuit 418, and resistors R4 and R5. Sensor 412 may receive the oscillation signal from oscillation circuit 410. PLL 418 of sensor 412 may be configured to detect any changes in the frequency of the oscillation signal. For example, changes in the frequency of the oscillation signal may correspond to the presence of external source 102 near oscillation circuit 410. External source 102 may comprise, for example, a magnet. Once sensor 412 detects the change in frequency of the oscillation signal caused by the magnet, it may output an appropriate detect output signal.

In one embodiment, circuit 400 may also comprise sensor 416. Sensor 416 may comprise a comparator 422, resistors R10 and R11, and transistor T2. Sensor 416 may also receive the oscillation signal from oscillation circuit 410 via AGC circuit 414. Sensor 416 may be configured to detect any changes in the amplitude of the oscillation signal via comparator 422 and transistor T2. For example, changes in the amplitude of the oscillation signal may correspond to the presence of external source 102 near oscillation circuit 410. External source 102 may comprise, for example, an amount of metal. Once sensor 416 detects the change in amplitude of the oscillation signal caused by the metal, it may output an appropriate detect output signal.

Although only two sensors are shown in FIG. 4, it may be appreciated that any number of sensors may be used with circuit 400 and still fall within the scope of the embodiments. Sensors 412 and 416 may be discussed in more detail with reference to FIG. 9.

In one embodiment, circuit 400 may also comprise AGC 414. AGC 414 may comprise an amplifier 420, resistors R6–R9, transistor T1 and capacitor C1. AGC 414 may control the gain for oscillation circuit 410. Amplifier 420 of AGC 414 may receive the amplified signal from amplifier 408 of oscillation circuit 410. Amplifier 420 may output an amplifier voltage to transistor T1 to form a gain control signal. The gain control signal may be received as input for amplifier 408 of oscillation circuit 410.

In one embodiment, circuit 400 may comprise oscillation circuit 410. Oscillation circuit 410 may be an example of an implementation for oscillation module 202. Oscillation circuit 410 may comprise a drive coil 402, a sense coil 404, a marker 406, an amplifier 408, and resistors R1, R2 and R3.

In one embodiment, oscillation circuit 410 may comprise a marker 406. Marker 406 may comprise an amorphous magnetostrictive strip. For example, marker 406 may be a marker, such as acoustically resonant magnetic marker, a magnetic marker, a magneto-mechanical marker, and so forth. The embodiments are not limited with respect to the type of marker used with oscillation circuit 410 as long as it emits an oscillation signal at the proper frequencies.

In one embodiment, for example, marker 406 may comprise a magneto-mechanical resonant marker. Magneto-mechanical resonant markers may include an active element and a bias element. When the bias element is magnetized in a certain manner, the resulting bias magnetic field applied to the active element causes the active element to be mechanically resonant at a predetermined resonant frequency upon exposure to an AC magnetic field which alternates at the predetermined frequency. Exposing the active element to an AC magnetic field causes the magneto-mechanical resonant marker to resonate or vibrate. As the marker resonates mechanically, its magnetization also varies to create flux reversals in the magnetic field.

In one embodiment, oscillation circuit 410 may comprise sense coil 404. Sense coil 404 may be configured to induce voltage in response to the flux reversals caused by marker 406. Sense coil 404 may comprise at least two inductor coils 404A and 404B connected in series and wound in phase opposition. Marker 406 may be placed in one of the two coils, such as coil 404A. Coil 404B may be left empty.

In one embodiment, oscillation circuit 410 may comprise drive coil 402. Drive coil 402 may comprise a coil wound around coils 404A and 404B. Since drive coil 402 is wound around both coils, the flux change from marker 406 may affect both coils substantially equally and therefore no net voltage is generated from the drive current for drive coil 402. Consequently, only a flux change from marker 406 provides a net input voltage to amplifier 408. Accordingly, the oscillating condition is mainly dependent on the resonance of marker 406.

As previously discussed, sense coil 404 may be implemented using two inductor coils 404A and 404B to reduce interference between sense coil 404 and drive coil 402. As a result, the voltage output that appears across the terminals of sense coil 404 is due primarily to the magnetic response of marker 406. Alternatively, sense coil 404 may also be implemented using a single inductor coil as well. In this case, sense coil 404 may be configured such that the voltage induced in sense coil 404 alone is substantially smaller than the contribution from marker 406. Using a single coil for sense coil 404 may result in lower costs and smaller form factors relative to other implementations. The embodiments are not limited in this context.

The operation principle for oscillation circuit 410 may be analogous to a piezoelectric quartz oscillator. A quartz crystal is an electric field device. The voltage generated across the electrodes of the piezoelectric crystal can be coupled directly to the input of the oscillator amplifier. Similarly, sense coil 404 may be used to generate voltage from the flux reversal of the resonating magnetic strip, such as marker 406.

In general operation, oscillation circuit 410 may be configured so that the amplified signal generated by amplifier 408 follows the natural resonant frequency of marker 406. For example, drive coil 402 may generate a magnetic field. Marker 406 may generate a marker signal in response to the magnetic field. The marker signal may be the resonant frequency of marker 406, for example. Sense coil 404 may receive the marker signal. Amplifier 408 may amplify the marker signal to form an amplified signal. Drive coil 402 may receive the amplified signal and increase the magnetic field accordingly. This loop gain may continue to increase the amplified signal until gain for the amplified signal reaches a predetermined threshold to form the self-sustaining oscillation signal. The oscillation signal may have a resulting frequency that substantially matches the frequency of the marker signal generated by marker 406.

As oscillation circuit 410 oscillates, the oscillation signal is self-maintained. Amplifier 408 drives a current ($I_d$) though drive coil 402. Drive coil 402 generates an AC magnetic field to resonate marker 406. As marker 406 resonates mechanically, its magnetization also varies. Such a flux reversal is then picked up as voltage induced across sense coil 404. Consequently, marker 406 together with drive coil 402 may operate as an antenna which produces an AC magnetic field signal at the operating frequency. Accordingly, remote sensing of the operating frequency can therefore be achieved by placing a receiver in its proximity.

In one embodiment, oscillation circuit 410 should be configured to have an overall loop gain of greater than one to sustain the appropriate oscillation. The overall loop gain may be made up of three different portions, such as amplifier gain ($A_v$), drive current amplitude ($I_d$), and transducer gain ($G_{trans}$). The loop gain may be discussed in more detail with reference to FIGS. 5–8.

Figure 5:
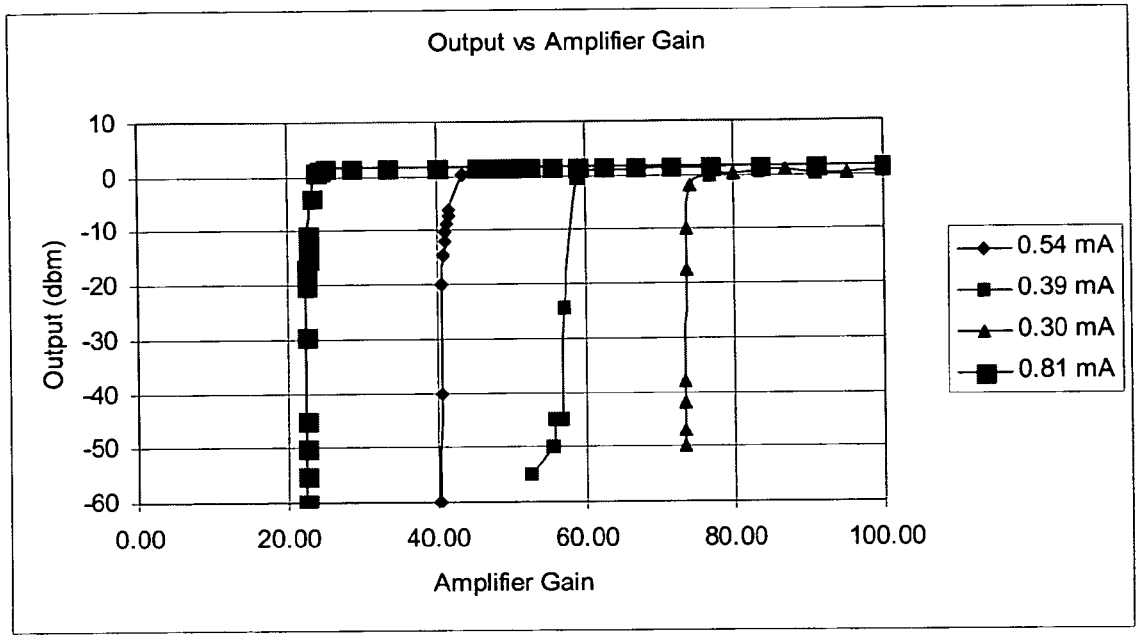
FIG. 5 illustrates a graph of the turn-on characteristics as a function of amplifier gain in accordance with one embodiment.

FIG. 5 illustrates a graph of the turn-on characteristics as a function of amplifier gain in accordance with one embodiment. As discussed previously, the overall loop gain of oscillation circuit 410 must be greater than one to generate the oscillation signal. The gain of amplifier 408 may comprise one of the contributing factors, and therefore may affect the overall performance of oscillation circuit 410. FIG. 5 illustrates the output voltage of oscillation circuit 410 as a function of amplifier gains at various drive current magnitudes from 0.3 to 0.81 milliampere. At a specific drive current, oscillation circuit 410 may not oscillate until the amplifier voltage of amplifier 408 reaches one critical value. Oscillation circuit 410 begins to oscillate and the amplifier voltage reaches a maximum magnitude almost instantly once the gain exceeds the critical value. This critical gain may decrease as the drive current increases.

Figure 6:
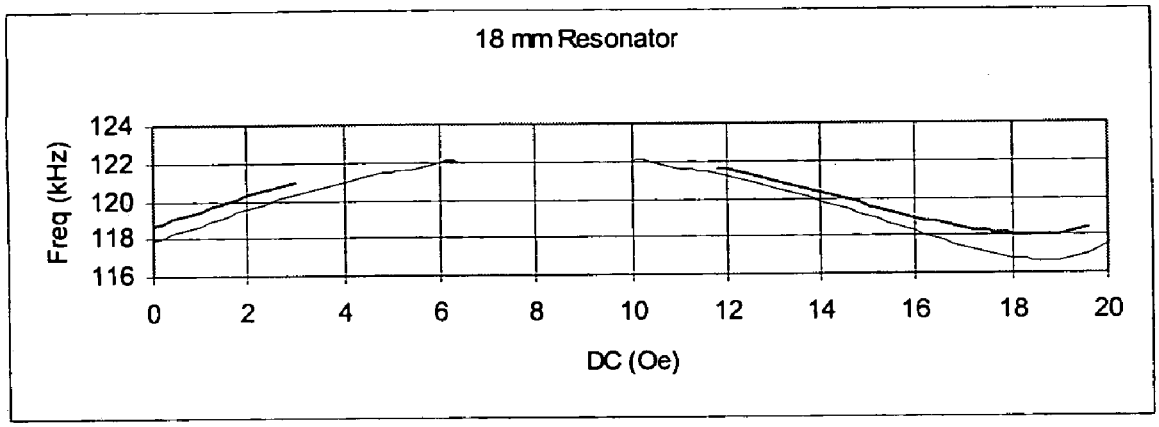
FIG. 6 illustrates a graph of the resonant frequencies of an oscillator module and component marker in accordance with one embodiment.

FIG. 6 illustrates a graph of the resonant frequencies of an oscillator module and component marker in accordance with one embodiment. Similar to marker 406, the oscillation signal may also be dependent on the magnetic field. As shown in FIG. 6, the frequency of the oscillation signal output from oscillator circuit 410 (top line), and the frequency of the marker signal from marker 406 (bottom line), are plotted as a function of the ambient magnetic field. The frequency-magnetic field relation is similar. The slightly higher frequency of the oscillation signal may be accounted for by the incomplete cancellation of the sense coils 404A and 404B.

Figure 7:
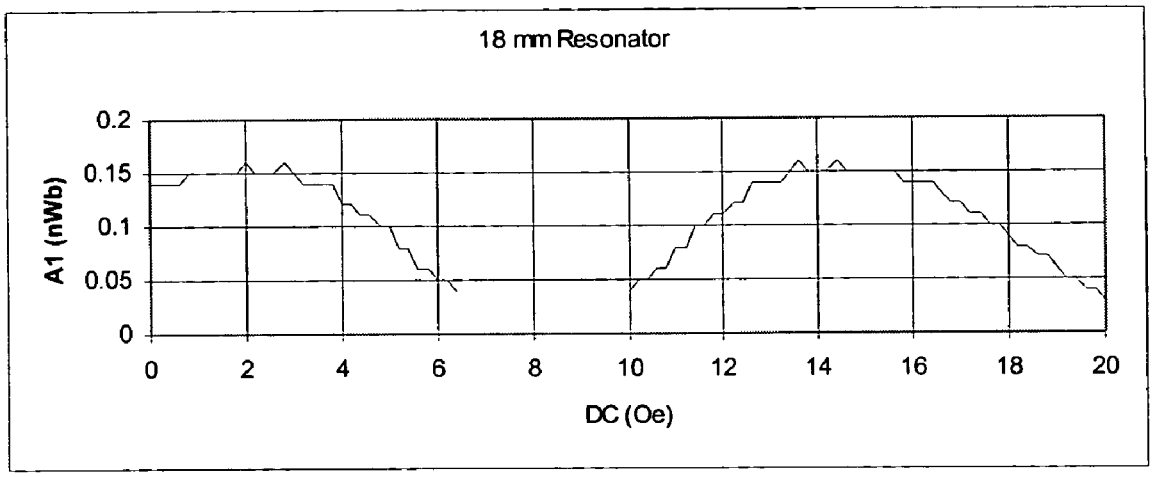
FIG. 7 illustrates a graph of the magnetic amplitude of a marker in accordance with one embodiment.

FIG. 7 illustrates a graph of the magnetic amplitude of a marker in accordance with one embodiment. FIG. 7 may illustrate the marker signal intensity of marker 406. The response may have a linear relation with the AC drive region. The amplitude reaches zero, with an external DC bias of 8.2 Oe, which is also the required external DC field that is needed to cancel the effective magnetic field provide by marker 406. In other words, marker 406 resonates except when the internal magnetic bias field is zero. It is worthy to note, however, that this may not be necessarily true for oscillation circuit 410.

Figure 8:
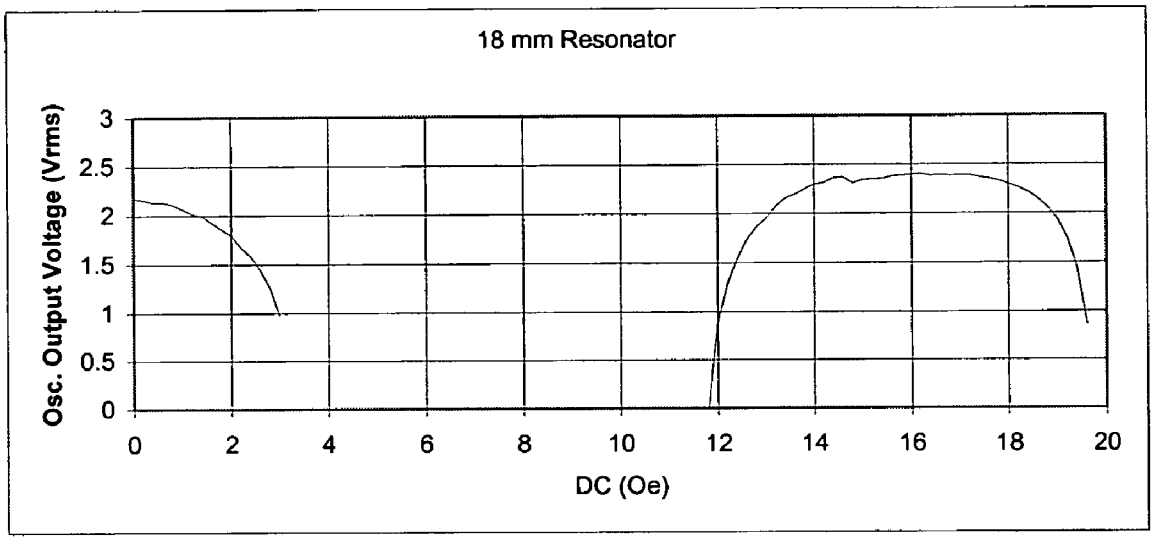
FIG. 8 illustrates a graph of the output voltage of an oscillation module as a function of Direct Current (DC) magnetic field strength in accordance with one embodiment.

FIG. 8 illustrates a graph of the output voltage of an oscillator module as a function of DC magnetic field strength in accordance with one embodiment. As discussed previously, oscillator circuit 410 may be configured to function only when the total loop gain is greater than one. The response of the transducer ($G_{trans}$) may contribute to the total loop gain. It is therefore possible that the total loop gain may be lower than one as a result of poor transducer efficiency. FIG. 8 may illustrate this event when the external magnetic field is between 3 and 12 Oe.

The operation of systems 100 and 200, the programming logic shown in FIG. 3, and the circuit shown in FIG. 4, may be better understood by way of example. As shown in FIG. 5, oscillation circuit 410 may operate critically when the amplifier gain is near its threshold value. Any slight change of the overall loop gain can significantly alter the performance of oscillation circuit 410. A detector such as detector 106 may use this capability for a number of sensing applications. Using the techniques described herein, detector 106 may be configured to operate as a physical and/or chemical sensor, due to the mass loading characteristics of marker 406 and corresponding oscillation circuit 410.

In one embodiment, for example, detector 106 may be configured to operate as a metal detector. Assume that external source 102 comprises an amount of metal, such as a deadbolt for a door. Oscillation circuit 410 may be configured to detect the proximity of a metal object due to the additional eddy current loss introduced by metal as it approaches drive coil 402. This capability of metal detection can be improved by planarizing drive coil 402 to maximize the coupling to the approaching metals. Detector 106 may be installed into the deadbolt well to sense the arming status of the deadbolt. In addition, if a magnet is installed in the door near the unit, the door open/close status can also be detected by detecting the frequency shift in the oscillator circuit due to the change in the local magnetic field strength. By combining the magnetic field and eddy current detection, an integrated approach for door/deadbolt status sensing can be realized. This may be discussed in more detail with reference to FIG. 9.

Figure 9:
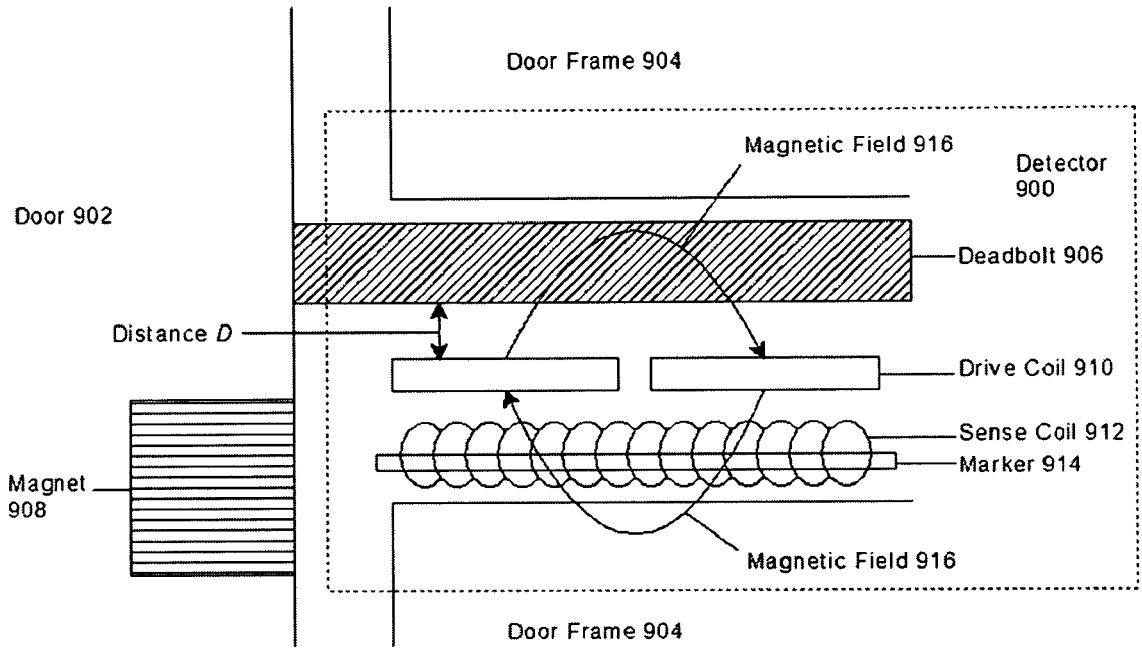
FIG. 9 illustrates an implementation example of a detector in accordance with one embodiment.

FIG. 9 illustrates an implementation example of a detector in accordance with one embodiment. FIG. 9 illustrates a detector 900 for a security system to monitor a door. In this example, detector 900 may be embedded in a door frame 904 near the locking mechanism for the door. Detector 900 may configured to detect when a door 902 is in an open position or a closed position. Door 902 may include a magnet 908 to assist in this detection. In this example, magnet 908 may be an example of external source 102. Detector 900 may also be configured to detect when a metal deadbolt 906 is in the locked position or unlocked position. In this example, deadbolt 906 may be an example of external source 102.

In one embodiment, for example, detector 900 may be representative of circuit 400. Although detector 900 is shown in FIG. 9 with only a drive coil 910, a sense coil 912, and a marker 914 for purposes of clarity, the other elements of circuit 400 are assumed to be present for purposes of this example.

As shown in FIG. 9, drive coil 910 may generate an AC magnetic field 916. AC magnetic field 916 may cause marker 914 to resonate at a resonant frequency. Sense coil 912 may receive the marker signal from marker 914, and output the appropriate oscillation signal from the oscillation circuit.

In one example, detector 900 may be configured to detect when a metal deadbolt 906 is in the locked position or unlocked position. When in the unlocked position, deadbolt 904 may recede into door 902 and therefore not interfere with AC magnetic field 916. When in the locked position (as shown), however, the position of detector 900 in door frame 904 may be such that the locked deadbolt 906 may couple with AC magnetic field 916. The presence of the metal in deadbolt 906 creates AC eddy current loss as it approaches drive coil 910. This is because the deadbolt metal will absorb some of AC magnetic field 916. The resulting AC eddy current loss may change the amplitude of the oscillation signal from oscillation circuit 410. The change in amplitude may be detected by sensor 416, which outputs a detect output signal to alarm system 108.

One problem with implementing a detector similar to detector 900 may be caused by the improper installation of deadbolt 906. When installing the locking mechanism for the door, the deadbolt may be varying distances D from drive coil 910 when in the locked position. The variation in distance may affect the amount of coupling between deadbolt 906 and drive coil 910. To account for this variation in distances, AGC 414 may be configured to automatically adjust the gain of oscillation circuit 410 to compensate for the resulting gap. For example, AGC 414 may output a gain control signal to comparator 422 of sensor 416. The embodiments are not limited in this context.

In one example, detector 900 may configured to detect when a door 902 is in an open position or a closed position. When door 902 is in the open position, magnet 908 may be far enough from detector 900 so that magnet 908 does not interfere with a characteristic of a marker, such as the amplitude and/or frequency of marker 914. When door 902 is in the closed position (as shown), however, magnet 908 may be near enough to detector 900 so that magnet 908 does interfere with a characteristic of marker 914. For example, magnet 908 may project a DC magnetic field. When in the closed position, the DC magnetic field of magnet 908 may cause a shift in the resonant frequency of marker 914. The shift in resonant frequency of marker 914 may case a corresponding frequency shift in the oscillation signal from oscillation circuit 400. The frequency shift may be detected by sensor 412, which outputs a detect output signal to alarm system 108.

Detector 900 and circuit 400 may also be configured to use the absence of a DC magnetic field to trigger an alarm signal. For example, an intruder may attempt to defeat a security system using detector 900 by tampering with detector 900 itself. The intruder may remove a cover for detector 900 and attempt to disable one or more components of detector 900. To reduce this risk, a magnet may be embedded in a part of detector 900, such as the housing or cover. Oscillation circuit 410 may generate an oscillation signal corresponding to marker 914 that is tuned to the presence of the magnet. If the magnet is removed a certain distance from marker 914, the absence of the magnet may cause a frequency shift in the resonant frequency of marker 914, and thus a corresponding frequency shift in the oscillation signal of oscillation circuit 410. The frequency shift in the oscillation signal may be detected and used to trigger an alarm signal.

In one embodiment, detector 106 may be configured to operate as a chemical detector. The frequency dependence on the properties of marker 406 may be described using the following equation:

$$Freq = \frac{1}{2L} * \sqrt{\frac{E}{\rho}}$$

where L, ρ, and E are the length, mass density, and Young's Modulus of marker 406, respectively. It is worthy to note that the natural frequency is dependent on the mass density (ρ), and therefore the mass (m) of the strip. The amount of frequency shift (ΔFreq) may be directly proportional to the incremental mass increase (Δm), as shown by the following equation:

$$\Delta Freq = \frac{Freq_0}{2} * \frac{\Delta m}{m_0}$$

where $Freq_0$, and $m_0$ are the initial frequency and mass of the strip, respectively.

Using the above, a chemical/gas sensor can be made by taking advantage of such a mass loading property by applying an absorbing/adsorbing coating on the active resonating strip. Such a coating is specially designed to absorb a specific type of analyte, such as a gas or chemical. As the analyte is absorbed into the coating, the amount of frequency shift may be measured and correlated with ambient concentration of the analyte.

The embodiments may be implemented using an architecture that may vary in accordance with any number of factors, such as desired computational rate, power levels, heat tolerances, processing cycle budget, input data rates, output data rates, memory resources, data bus speeds and other performance constraints. For example, portions of an embodiment may be implemented using software executed by a processor. The processor may be a general-purpose or dedicated processor, such as a processor made by Intel® Corporation, for example. The software may comprise computer program code segments, programming logic, instructions or data. The software may be stored on a medium accessible by a machine, computer or other processing system. Examples of acceptable mediums may include computer-readable mediums such as read-only memory (ROM), random-access memory (RAM), Programmable ROM (PROM), Erasable PROM (EPROM), magnetic disk, optical disk, and so forth. In one embodiment, the medium may store programming instructions in a compressed and/or encrypted format, as well as instructions that may have to be compiled or installed by an installer before being executed by the processor. In another example, portions of an embodiment may be implemented as dedicated hardware, such as an Application Specific Integrated Circuit (ASIC), Programmable Logic Device (PLD) or DSP and accompanying hardware structures. In yet another example, one embodiment may be implemented by any combination of programmed general-purpose computer components and custom hardware components. The embodiments are not limited in this context.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

The invention claimed is:

1. An apparatus, comprising:

an oscillation circuit to generate an oscillation signal by driving a signal to excite a marker, said marker generating said oscillation signal, said oscillation circuit to modify a characteristic of said oscillation signal in response to a proximate external source; and a sensor to receive said oscillation signal, detect the modification, and generate a detect output signal in accordance with said detection indicative of said proximate external source.

2. The apparatus of claim 1, wherein said characteristic comprises a frequency, and said sensor receives said oscillation signal and detects a change in said frequency of said oscillation signal, said sensor to output a detect output signal to represent said detected change in frequency.

3. The apparatus of claim 1, wherein said characteristic comprises an amplitude, and said sensor receives said oscillation signal and detects a change in said amplitude of said oscillation signal, said sensor to output a detect output signal to represent said detected change in amplitude.

4. The apparatus of claim 1, wherein said external source comprises one of a metal, a magnet, stress, and temperature.

5. The apparatus of claim 1, wherein said oscillation circuit comprises:

a drive coil to generate a magnetic field;

said marker to generate a marker signal in response to said magnetic field;

a sense coil to receive said marker signal;

an amplifier to amplify said marker signal to form an amplified signal; and wherein said drive coil to increase said magnetic field in response to said amplified signal, with said oscillation circuit to continue increasing said amplified signal until gain for said amplified signal reaches a predetermined threshold to form said oscillation signal.

6. The apparatus of claim 5, wherein said oscillation signal has a frequency substantially matching a frequency of said marker signal.

7. The apparatus of claim 5, further comprising an automatic gain control circuit to connect to said oscillation circuit, said automatic gain control circuit to receive said amplified signal, determine an amount of gain for said amplified signal, and generate a gain control signal in accordance with said determination.

8. The apparatus of claim 7, wherein said amplifier receives said gain control signal and adjusts gain for said amplified signal in accordance with said gain control signal.

9. The apparatus of claim 5, wherein said sense coil comprises at least two coils connected in series and wound in phase opposition, with one coil having said marker.

10. The apparatus of claim 9, wherein said drive coil is wound around both coils to create approximately equal flux change in both coils.

11. The apparatus of claim 5, wherein said marker has an outer coating to absorb an analyte, and a frequency of said marker signal changes in response to an amount of analyte absorbed by said outer coating.

12. The apparatus of claim 11, wherein said analyte comprises one of a chemical and a gas.

13. The apparatus of claim 5, wherein said sense coil comprises one inductor coil having said marker.

14. The apparatus of claim 5, wherein said drive coil is planarized to improve coupling with said external source.

15. A method, comprising:

generating an oscillation signal by driving a signal to excite a marker, said marker generating said oscillation signal;

modifying a characteristic of said oscillation signal in response to a proximate external source;

detecting the characteristic modification; and generating a detect output signal in accordance with said detection indicative of said external source.

16. The method of claim 15, wherein said generating comprises:

creating a magnetic field;

generating a marker signal in response to said magnetic field;

receiving said marker signal;

amplifying said marker signal to form an amplified signal; and increasing said magnetic field in response to said amplified signal.

17. The method of claim 16, wherein said marker signal is continuously amplified until gain for said amplified signal reaches a predetermined threshold to form said oscillation signal.

18. The method of claim 16, wherein said amplifying comprises:

receiving said amplified signal;

determining an amount of gain for said amplified signal; and generating a gain control signal in accordance with said determination.

19. The method of claim 16, wherein said oscillation signal has a frequency substantially matching a frequency of said marker signal.

20. The method of claim 15, wherein said characteristic comprises a frequency, and said detecting comprises:

detecting a change in said frequency of said oscillation signal; and generating said detect output signal to represent said detected change in frequency.

21. The method of claim 15, wherein said characteristic comprises an amplitude, and said detecting comprises:

detecting a change in said amplitude of said oscillation signal; and generating said detect output signal to represent said detected change in amplitude.

22. A system, comprising:

proximate external source;

a detector to detect said proximate external source, said detector comprising an oscillation circuit to generate an oscillation signal by driving a signal to excite a marker, said marker generating said oscillation signal, said oscillation signal having a frequency to match a marker signal from said marker, with a characteristic of said marker signal to change in response to said proximate external source; and a sensor to monitor said characteristic and detect said change, and generate a detect output signal to represent said change in said characteristic, said detection indicative of said proximate external source.

23. The system of claim 22, further comprising an alarm system to receive said detect output signal, and generate at least one of an audible sound and visual indicator to represent a change in a characteristic of said oscillation signal in response to said external source signal.

* * * * *